US009896661B1

(12) United States Patent
Alshatwi et al.

(10) Patent No.: US 9,896,661 B1
(45) **Date of Patent: *Feb. 20, 2018**

(54) METHOD OF PRODUCING CELLULOSE NANOSTRUCTURES

(71) Applicant: KING SAUD UNIVERSITY, Riyadh (SA)

(72) Inventors: Ali Abdullah Alshatwi, Riyadh (SA); Jegan Athinarayanan, Riyadh (SA); Periasamy Vaiyapuri Subbarayan, Riyadh (SA); Khalid Abdulkarim Alatiah, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/343,163

(22) Filed: Nov. 3, 2016

(51) Int. Cl.

| | |
|---|---|
| ***C01B 33/12*** | (2006.01) |
| ***C12N 5/0775*** | (2010.01) |
| ***D21C 1/06*** | (2006.01) |
| ***D21C 1/04*** | (2006.01) |

(52) U.S. Cl.
CPC ..... *C12N 5/0662* (2013.01); *D21C 1/04* (2013.01); *D21C 1/06* (2013.01); *C12N 2533/78* (2013.01)

(58) Field of Classification Search
CPC ..... C12N 5/0662
See application file for complete search history.

(56) References Cited

U.S. PATENT DOCUMENTS

| | | | |
|---|---|---|---|
| 9,193,949 | B1 | 11/2015 | Alshatwi et al. |
| 2011/0274742 | A1 | 11/2011 | Arinzeh et al. |

FOREIGN PATENT DOCUMENTS

| | | | |
|---|---|---|---|
| CN | 101979104 | A | 2/2011 |
| CN | 102206289 | A | 10/2011 |
| CN | 103933101 | A | 7/2014 |

OTHER PUBLICATIONS

Li, et al. Carbohydrate Polymers, 2009, 76:94-99.*
Abe et al. Carbohydrate Polymers, 2011, 85:733-737.*
Yusufoglu et al. Annual Research & Review in Biology, 2015, 5(5):400-408.*
Willerth, Stephanie M., and Shelley E. Sakiyama-Elbert. "Combining stem cells and biomaterial scaffolds for constructing tissues and cell delivery." (2008).

* cited by examiner

*Primary Examiner* — Bin Shen
(74) *Attorney, Agent, or Firm* — Richard C. Litman

(57) ABSTRACT

A method of producing cellulose nanostructures includes obtaining *Bassia eriophora* plant biomass and treating the *Bassia eriophora* plant biomass to produce the cellulose nanostructures. The cellulose nanostructures can be used as a three-dimensional scaffold for growing three-dimensional cell cultures, such as human mesenchymal stem cell cultures. The cellulose nanostructures can be cellulose nanofibrils.

1 Claim, 7 Drawing Sheets

100 µg/mL

200 µg/mL

400 µg/mL

Control

25 µg/mL

50 µg/mL

METHOD OF PRODUCING CELLULOSE NANOSTRUCTURES

BACKGROUND OF THE INVENTION

1. Field of the Invention

The present invention relates to the formation of cellulose nanostructures, and particularly, to a method of making cellulose nanostructures from *Bassia eriophora* plant biomass.

2. Description of the Related Art

Common materials used for three-dimensional culture models are typically derived from various natural or synthetic sources, such as polymers, polyethylene glycol, inorganic composites, chitosan, collagen, alginate, organic hydrogels and nanofibers. However, the lack of multiple-functionalization, limited surface modification, poor mechanical strength, chemical hydrolysis, lack of biocompatibility, insensitivity to enzymatic processes, lack of cell specificity, biodegradability, and limited processability make these materials inefficient and often ineffective for their intended purpose.

Cellulose is of particular interest for the formation of biocompatible matrices and scaffolds for growing and culturing cells. Plant biomass is an important and major source of cellulose. Numerous types of plant biomass have been utilized as a precursor for cellulose nanostructure fabrication, such as the pineapple leaf, banana, bamboo, wood, garlic straw, *Arundo donax*, sugarcane bagasse, coconut fiber, oil palm trunk, tomato peels, saw dust waste, cotton linter, *Agave tequilana*, barley, *Phormium tenax*, hemp, rice husk, wheat straw, soy hull, alfa fibers and corncob. These examples have shown that cellulose nanofibers may be derived from plant biomass.

However, the overall suitability of a particular plant for use as a cellulose source in the construction of cellular scaffolds depends on the chemical composition of the particular plant. Agricultural residues are mainly composed of cellulose, lignin and hemicelluloses. In order to produce an effective cellular scaffold, a high concentration of cellulose and low concentrations of lignin and hemicellulose are desired.

Thus, a method of making a plant-based three-dimensional scaffold for three-dimensional cell cultures solving the aforementioned problems is desired.

SUMMARY OF THE INVENTION

A method of producing cellulose nanostructures includes obtaining *Bassia eriophora* plant biomass and treating the *Bassia eriophora* plant biomass to produce the cellulose nanostructures. The cellulose nanostructures can be used as a three-dimensional scaffold for growing three-dimensional cell cultures, such as human mesenchymal stem cell cultures. Treating the *Bassia eriophora* plant biomass can include pulverizing the *Bassia eriophora* biomass to obtain powdered *Bassia eriophora*, which is then treated in a sodium hydroxide solution to obtain alkali-treated *Bassia eriophora*. The alkali-treated *Bassia eriophora* can be washed and dried, and then bleached to obtain bleached, alkali-treated *Bassia eriophora*. The bleached, alkali-treated *Bassia eriophora* can then be washed and dried to yield cellulose. The cellulose can be hydrolyzed with sulfuric acid to produce acid hydrolyzed cellulose, which is then dissolved in water to produce an aqueous cellulose solution. The aqueous cellulose solution can be centrifuged to yield a cellulose residue, which is then ultrasonicated.

These and other features of the present invention will become readily apparent upon further review of the following specification.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1A:
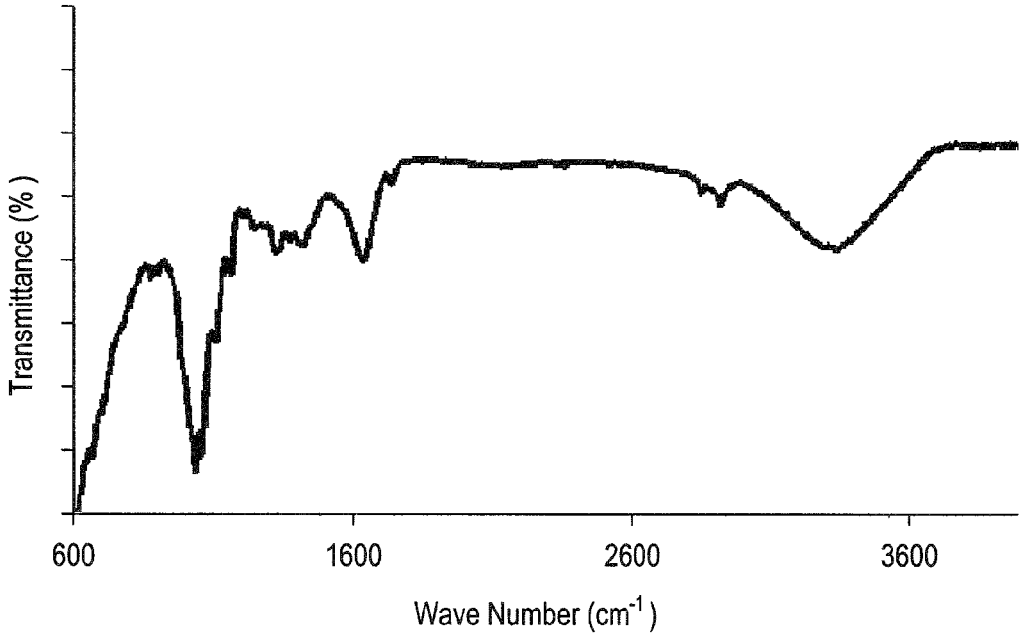
FIG. 1A is a graph showing Fourier transform infrared spectroscopy (FT-IR) transmittance results of untreated *Bassia eriophora* plant residue.
Figure 1B:
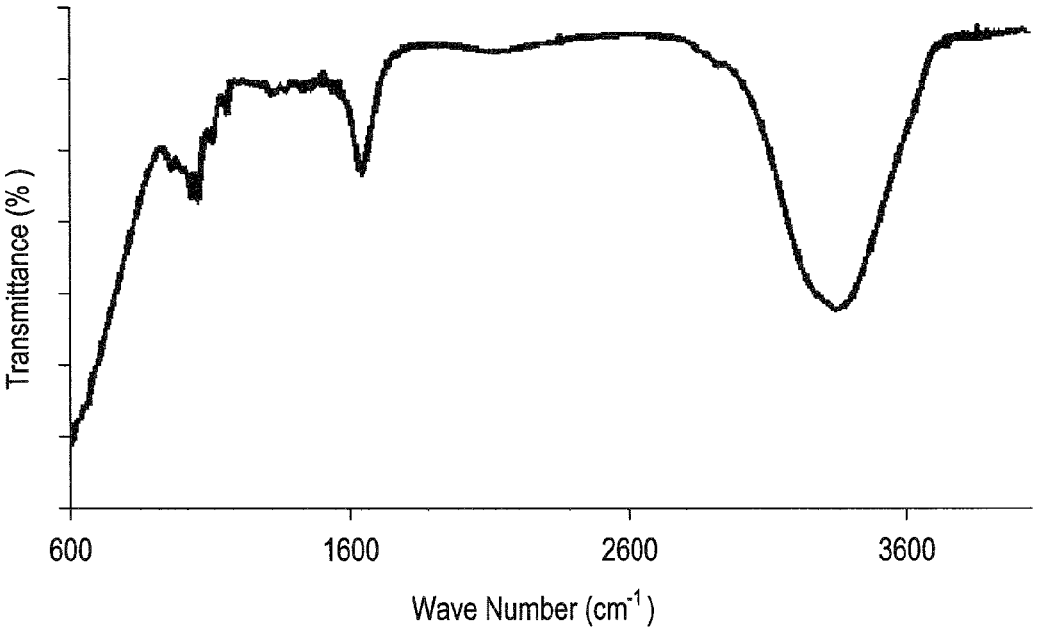
FIG. 1B is a graph showing Fourier transform infrared spectroscopy (FT-IR) transmittance results of alkali-treated *Bassia eriophora* plant residue prepared according to the present teachings.
Figure 1C:
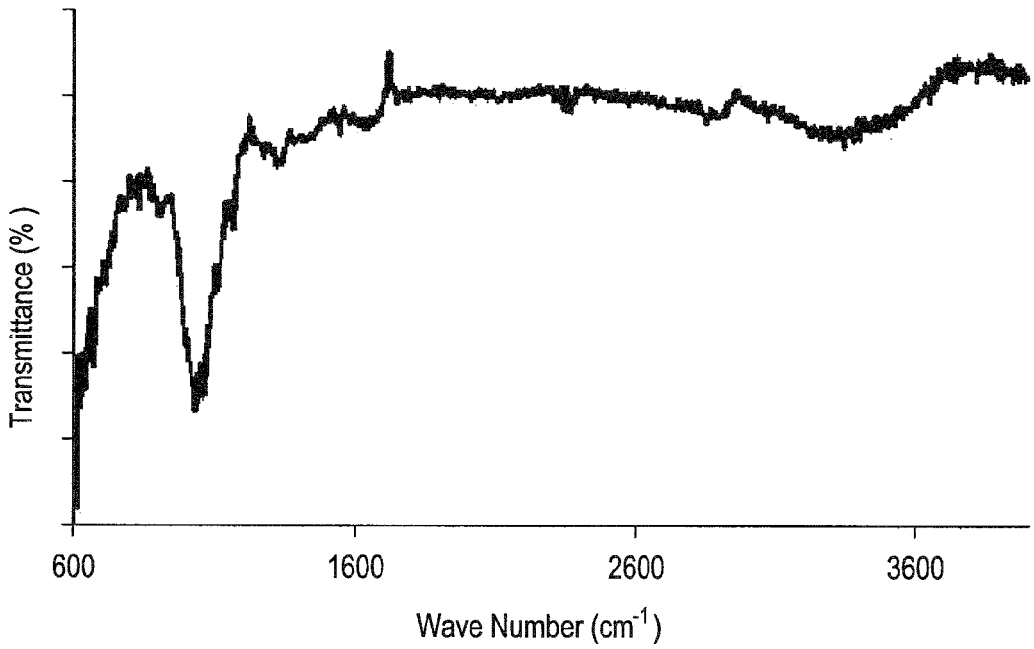
FIG. 1C is a graph showing Fourier transform infrared spectroscopy (FT-IR) transmittance results of bleached, alkali-treated *Bassia eriophora* plant residue prepared according to the present teachings.
Figure 1D:
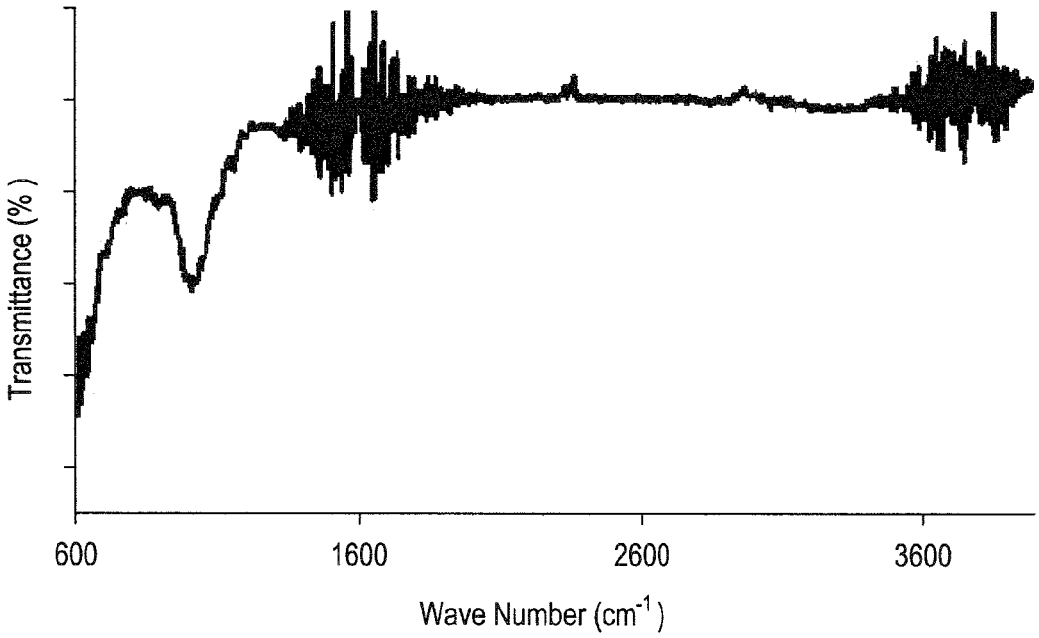
FIG. 1D is a graph showing Fourier transform infrared spectroscopy (FT-IR) transmittance results of cellulose nanofibrils derived from the *Bassia eriophora* plant according to the present inventive method.

A method of producing cellulose nanostructures includes providing *Bassia eriophora* biomass and treating the *Bassia eriophora* biomass to produce cellulose nanostructures. The *Bassia eriophora* biomass can include at least one of the leaves, stem, fruit, flowers, and seeds of the *Bassia eriophora* plant (a member of the amaranth family) The cellulose nanostructures can provide a three-dimensional scaffold for growing three-dimensional cell cultures, such as human mesenchymal stem cell cultures. The plant *Bassia eriophora* has an unusually high concentration of cellulose (72%), with small concentrations of lignin (12%) and hemicelluloses (16%). Accordingly, *Bassia eriophora* is an ideal source from which to extract cellulose for forming cellulose nanostructures, e.g., microfibrillated cellulose, cellulose nanofibers, microcrystalline cellulose, cellulose whiskers, cellulose nanocrystals, nanofibrillated cellulose, tunicate cellulose nanocrystals, algae cellulose particles, and bacterial cellulose particles.

An exemplary method of making cellulose nanostructures and using the cellulose nanostructures as a three-dimensional scaffold are provided in the experiments detailed herein. The *Bassia eriophora* plant was initially collected and then washed, with tap water or the like, to obtain a washed *Bassia eriophora* plant free from sand, dust and the like. The washed *Bassia eriophora* plant was then dried and pulverized to obtain powdered *Bassia eriophora*, which was then treated in an alkaline solution, e.g., sodium hydroxide solution, to obtain alkali-treated *Bassia eriophora*. Specifically, about 25 g of the powdered *Bassia eriophora* was immersed in 3.0 vol % sodium hydroxide solution. The mixture was kept in an autoclave at approximately 120° C. for approximately two hours under pressurized conditions.

The alkali-treated *Bassia eriophora* was then washed to remove excess alkali solution. The washing was repeated twice. The washed, alkali-treated *Bassia eriophora* was then dried at approximately 50° C. for approximately eight hours, and then bleached with a 1:1 solution of acetate buffer (27 g of NaOH and 75 mL of acetic acid in 1 L of water) and 1.7% sodium hypochlorite in an autoclave at approximately 120° C. for approximately one hour.

The bleached, alkali-treated *Bassia eriophora* was then washed until a neutral pH was achieved, and then dried at approximately 50° C. for approximately eight hours to yield cellulose. The cellulose was then hydrolyzed with 50% sulfuric acid (10 mL/g) at approximately 45° C. for approximately 30 minutes under stirring. The acid hydrolyzed cellulose was then diluted in ten-fold distilled water to produce an aqueous cellulose solution. In the experiments, the aqueous cellulose solution was centrifuged at 5,000 RPM for approximately 10 minutes to yield a cellulose residue. The cellulose residue was then ultrasonicated for approximately 20 minutes, centrifuged, and dried to produce the cellulose nanofibrils. As will be described in greater detail below, the prepared cellulose nanofibrils' structure and morphology were assessed using transmission electron microscopy (TEM). The functional groups were investigated using Fourier transform-infrared (FTIR) spectroscopy. The crystalline nature of the cellulose and cellulose nanofibrils was analyzed using X-ray diffraction. The thermal properties of the samples were investigated using a thermogravimetric analyzer.

Biocompatibility of the fabricated cellulose nanofibrils were assessed using cell viability assays and nuclear morphological assays (acridine orange/ethidium bromide). About 10,000 cells were seeded per well in a 96-well microtiter plate and were incubated at 37° C. for 24 hours. After incubation, the cells were exposed to differing concentrations of the fabricated cellulose nanofibrils (0, 25, 50, 100, 200 and 400 μg/mL) for 24 and 48 hours. Following this, 20 μL of a 3-(4,5-dimethylthiazol-2-yl)-2,5-diphenyltetrazolium bromide solution was added to each well and incubated for 4 hours at 37° C. Next, the plate was centrifuged and the suspension was carefully discarded. The purple color formazan crystals were dissolved in 100 μL of dimethyl sulfoxide (DMSO) per well, and the plates were monitored in a microplate reader at 570 nm. Data were collected in triplicate for each concentration of cellulose nanofibrils, and these data were used to calculate the mean. The percent of cell viability was calculated from these data.

For cellular and nuclear morphology analyses, the cells were seeded in 6-well plates and pre-treated with differing concentrations (0, 25, 50, 100, 200 and 400 μg/mL) of cellulose nanofibrils for 24 and 48 hours. After incubation, cellular morphology was observed using a bright field microscope. For the nuclear morphology analysis, the cells were treated with acridine orange/ethidium bromide and observed with a fluorescence microscope.

For the three-dimensional cell culture, a non-adherent cell culture plate with a diameter of about 60 mm was utilized. About 3 mL of Eagle's minimum essential medium (EMEM) was poured in the cell culture plate and the sterilized cellulose nanofibril film was immersed therein. Then, cells were seeded at a density of $4\times10^6$ cells in the plate and kept in an incubator. Three-dimensional culture growth was monitored every day and fresh media was replenished every three days. The three-dimensional growth of human mesenchymal stem cells (hMSCs) was assessed by microscopic observation.

FIGS. 1A, 1B, 1C and 1D show the Fourier transform infrared spectroscopy (FT-IR) transmittance results of untreated *Bassia eriophora* plant residue, alkali-treated *Bassia eriophora* plant residue, bleached, alkali-treated *Bassia eriophora* plant residue, and the inventive cellulose nanofibrils derived from the *Bassia eriophora* plant, respectively. Three regions were compared after different steps, such as (i) from 3600 to 3000 $cm^{-1}$ corresponding to the —OH stretching of cellulose, which is associated with the hydrogen bonding pattern, (ii) between 1500 and 1200 $cm^{-1}$, corresponding to the $CH_2$ wagging and COH in plane bending, and (iii) from 1180 to 800 $cm^{-1}$. The raw, untreated *Bassia eriophora* samples show peaks corresponding to cellulose, lignin and hemicellulose. However, the bleached residue and the cellulose nanofibril samples do not show the lignin and hemicellulose characteristic peaks. Thus, the alkali and bleaching treatment is seen to eliminate lignin and hemicellulose from raw *Bassia eriophora*.

Figure 2:
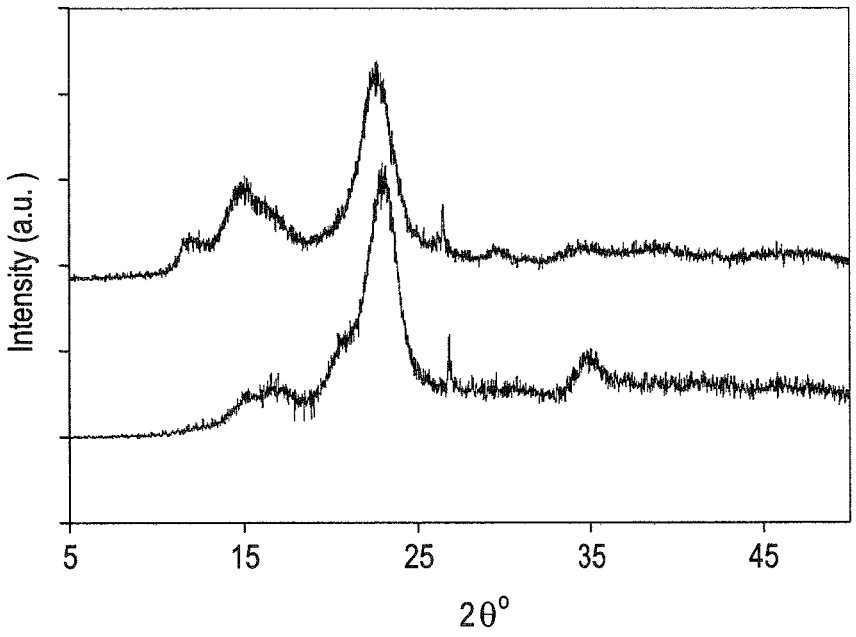
FIG. 2 is a graph showing X-ray diffraction (XRD) analysis of a cellulose sample (curve "a") and a cellulose nanofibril sample derived from the *Bassia eriophora* plant according to the present inventive method (curve "b").

FIG. 2 is a graph showing X-ray diffraction (XRD) analysis of a cellulose sample (curve "a") and a cellulose nanofibril sample derived from the *Bassia eriophora* plant according to the present inventive method (curve "b"). The XRD results show a number of peaks at 2θ=13.72°, 14.9°, 21.72°, 24.04°, 29.68°, 35.13°, 47.2° and 49.3°. However, only two peaks, at 14.7° and 22.66°, are responsible for cellulose and the other peaks correspond to impurities. Moreover, the "b" curve in FIG. 2 shows two diffraction peaks at 2θ values of 15.2° and 22.66°, which are attributed to (101) and (002) planes, respectively, and are related to the cellulose (I) structure.

Figure 3:
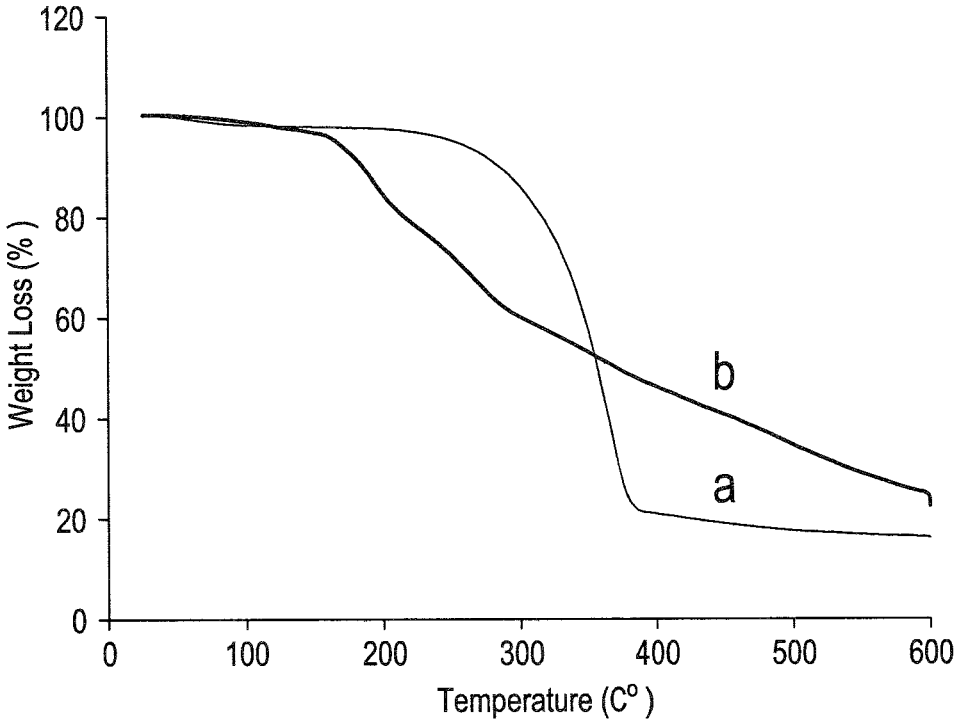
FIG. 3 is a graph showing thermogravimetric analysis results of a cellulose sample (curve "a") and a cellulose nanofibril sample derived from the *Bassia eriophora* plant according to the present inventive method (curve "b").

FIG. 3 is a graph showing thermogravimetric analysis results of a cellulose sample (curve "a") and a cellulose nanofibril sample derived from the *Bassia eriophora* plant according to the present inventive method (curve "b"). Curve "a" in FIG. 3 shows a slight cellulose weight loss, observed between 200° C. and 250° C., due to loss of moisture. A higher weight loss is shown between 300° C. and 400° C., due to cellulose degradation. In contrast, the cellulose nanofibrils (curve "b") exhibited heavy weight loss at 150° C., which corresponds to a high presence of sulfate groups on the cellulose nanofibrils. Around 50% of the weight loss occurs in the cellulose nanofibrils at 350° C. These results indicate that the sulfate groups play a significant role in the thermal properties of the cellulose nanofibrils.

Figure 4A:
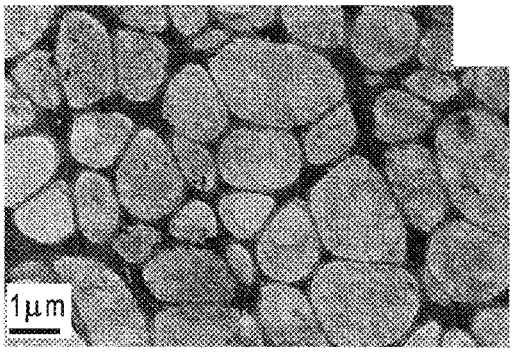
FIG. 4A is a transmission electron microscope (TEM) image of cellulose nanofibrils derived from the *Bassia eriophora* plant according to the present inventive method.
Figure 4B:
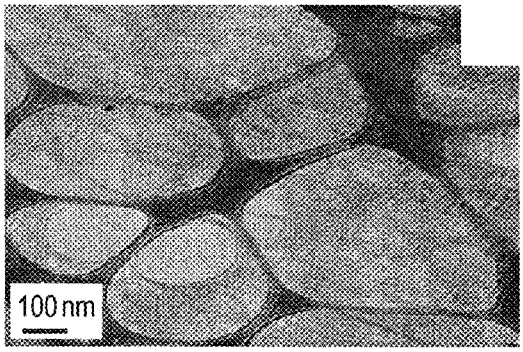
FIG. 4B is a transmission electron microscope (TEM) image of the cellulose nanofibrils of FIG. 4A at a higher magnification factor.

The morphological properties of the cellulose nanofibrils were studied using transmission electron microscopy, as shown in FIGS. 4A and 4B. The fabricated cellulose nanostructure has a fibrillated structure with a diameter of 10-30 nm and a length of 3-5 micrometers. The nanofibrils are interconnected in a netting arrangement, thus making them highly suitable for biomedical applications.

Figure 5:
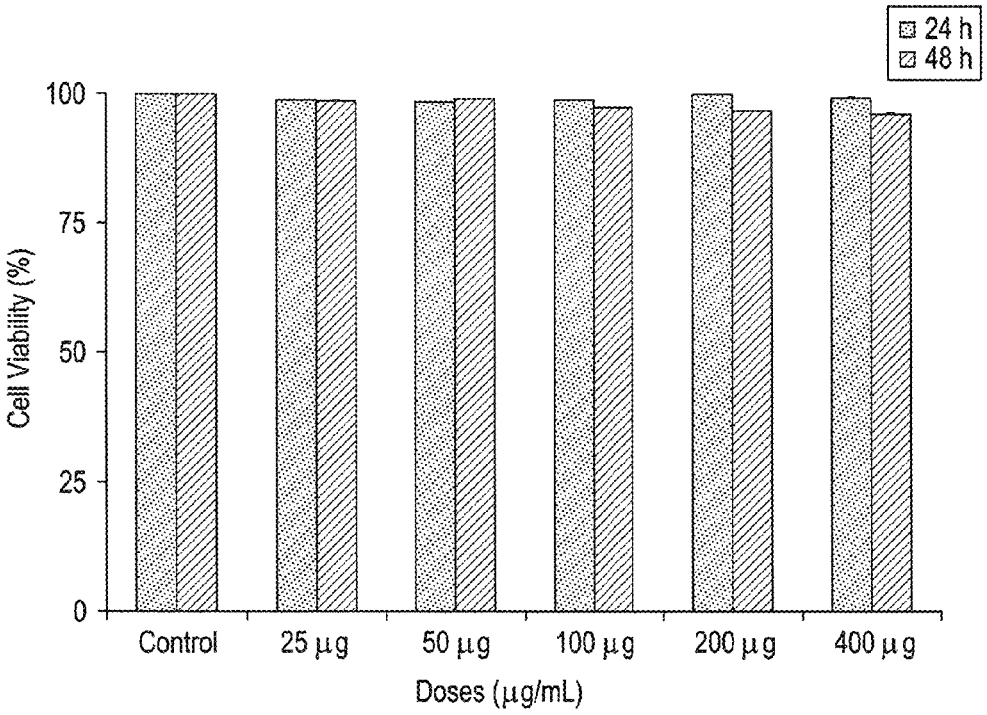
FIG. 5 is a graph illustrating cell growth and viability, represented by mean optical density via MTT assay, for human mesenchymal stem cells (hMSCs) cultured and grown on the three-dimensional scaffold produced according to the present inventive method.

FIG. 5 is a graph illustrating cell growth and viability, represented by mean optical density via MTT assay, for human mesenchymal stem cells (hMSCs) cultured and grown on the three-dimensional scaffold produced according to the present method. The cell viability slightly decreased from 99% to 98% at a high concentration of cellulose nanofibrils with an exposure time of 24 hours. Additionally, the cell viability declined from 99% to 96% with increased nanofibril concentration from 25 to 400 μg/mL for 48 hours. However, the cell viability rate did not decrease beyond 95%, even at high concentrations (400 μg/mL) of cellulose nanofibril exposure. The cell viability assay results strongly suggest that cellulose nanofibrils do not cause any significant change in cell growth. The nanofibrils show biocompatibility with hMSCs and are thus suitable for stem cell differentiation and stem cell based therapies.

Figure 6B:
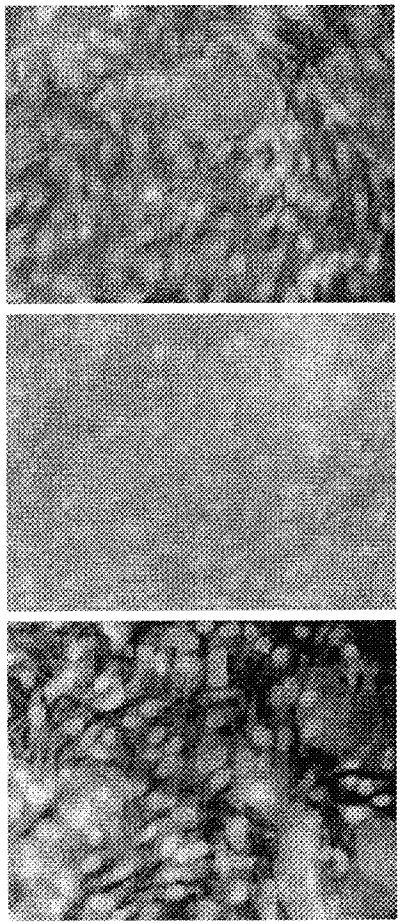
FIG. 6B is a comparison of fluorescent microscope images of hMSCs cultured and grown on three-dimensional scaffolds after 24 hours, with cellulose nanofibril concentrations of 100 μg/mL, cellulose nanofibril concentrations of 200 μg/mL, and cellulose nanofibril concentrations of 400 μg/mL.
Figure 6A:
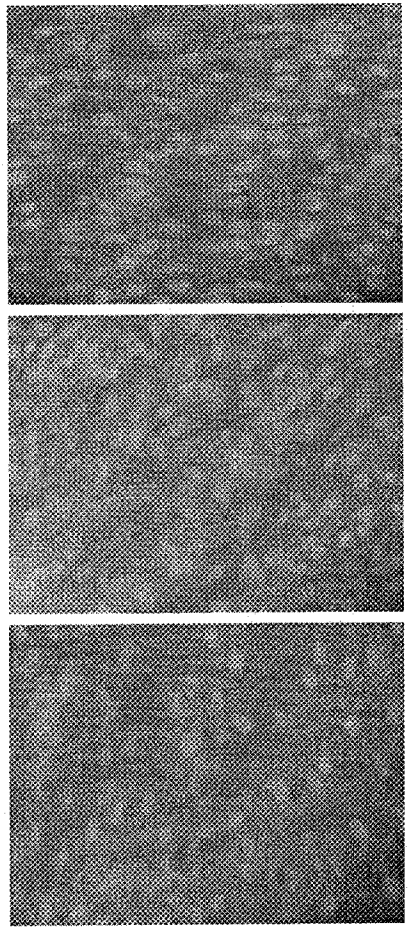
FIG. 6A is a comparison of fluorescent microscope images of a control sample of human mesenchymal stem cells (hMSCs) with hMSCs cultured and grown on three-dimensional scaffolds after 24 hours, with cellulose nanofibril concentrations of 25 μg/mL and cellulose nanofibril concentrations of 50 μg/mL.
Figure 7B:
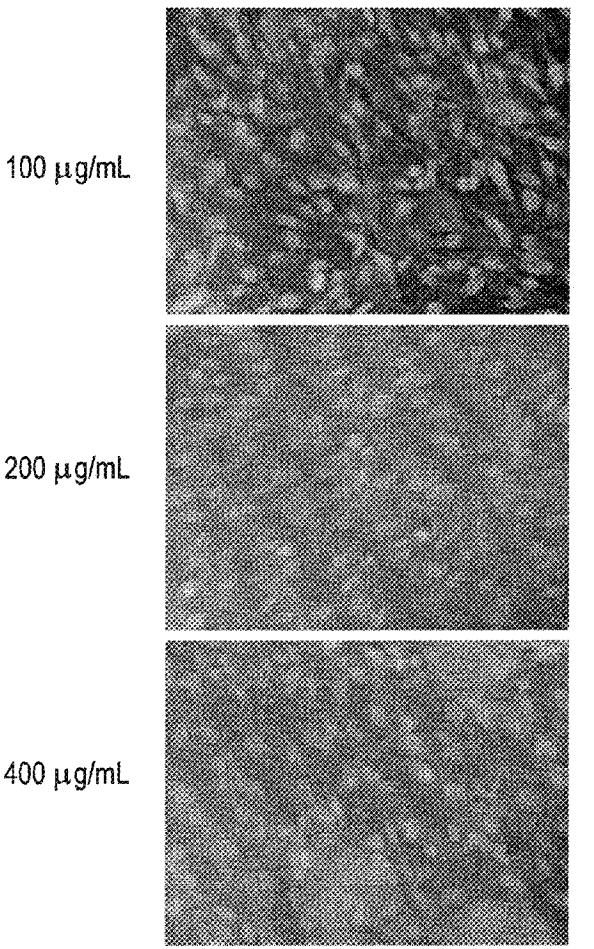
FIG. 7B is a comparison of fluorescent microscope images of hMSCs cultured and grown on three-dimensional scaffolds after 48 hours, with cellulose nanofibril concentrations of 100 μg/mL, cellulose nanofibril concentrations of 200 μg/mL, and cellulose nanofibril concentrations of 400 μg/mL.
Figure 7A:
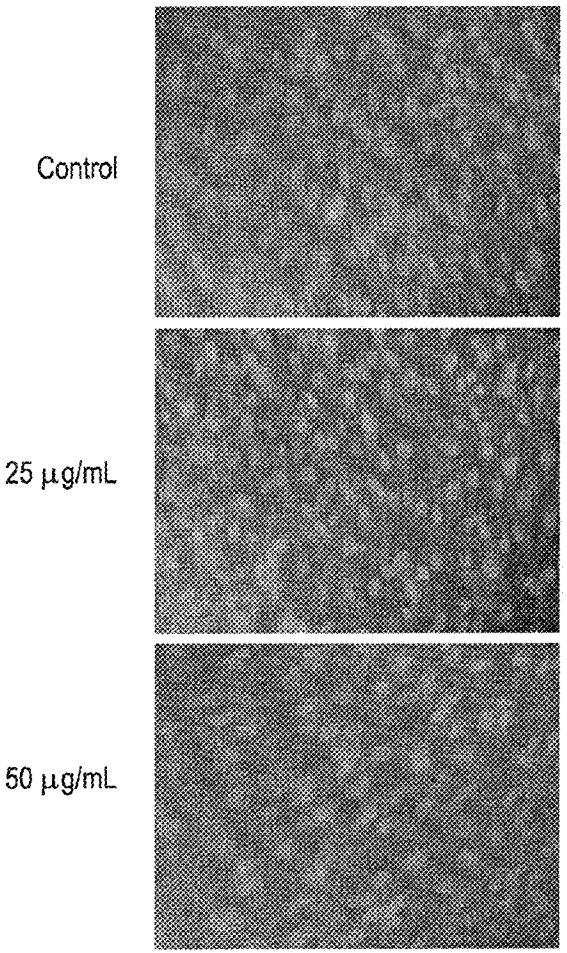
FIG. 7A is a comparison of fluorescent microscope images of a control sample of human mesenchymal stem cells (hMSCs) with hMSCs cultured and grown on three-dimensional scaffolds after 48 hours, with cellulose nanofibril concentrations of 25 μg/mL and cellulose nanofibril concentrations of 50 μg/mL.

The cellulose nanofibrils' effect on cellular and nuclear morphology of hMSCs was further investigated using both bright field and fluorescence microscopy. FIG. 6A is a comparison of fluorescent microscope images of a control sample of human mesenchymal stem cells (hMSCs) with hMSCs cultured and grown on three-dimensional scaffolds after 24 hours, with cellulose nanofibril concentrations of 25 μg/mL and cellulose nanofibril concentrations of 50 μg/mL. The fluorescent microscope images were prepared using acridine orange/ethidium bromide (AO/EB) staining. FIG. 6B compares fluorescent microscope images of hMSCs cultured and grown on three-dimensional scaffolds after 24 hours, with cellulose nanofibril concentrations of 100 μg/mL, cellulose nanofibril concentrations of 200 μg/mL, and cellulose nanofibril concentrations of 400 μg/mL. FIG. 7A is a comparison of fluorescent microscope images of a control sample of human mesenchymal stem cells (hMSCs) with hMSCs cultured and grown on three-dimensional scaffolds after 48 hours, with cellulose nanofibril concentrations of 25 μg/mL and cellulose nanofibril concentrations of 50 μg/mL. FIG. 7B compares fluorescent microscope images of hMSCs cultured and grown on three-dimensional scaffolds after 48 hours, with cellulose nanofibril concentrations of 100 μg/mL, cellulose nanofibril concentrations of 200 μg/mL, and cellulose nanofibril concentrations of 400 μg/mL.

Compared against the control cells, the cellular morphology of the hMSCs appeared to be healthier, forming elongated needle-like structures, with no observed changes. The fluorescent microscope images of cellulose nanofibril-treated cells appeared identical to those of the control cells, thus showing that the cellulose nanofibrils do not affect nuclear morphological changes, even with high concentrations and long exposure times. Additionally, no cell death was found in the fluorescence images.

Figure 8A:
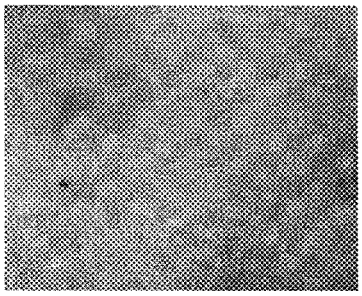
FIG. 8A is a fluorescent microscope image of human mesenchymal stem cells (hMSCs) cultured and grown on three-dimensional scaffolds prepared according to the present inventive method, shown after one day.
Figure 8B:
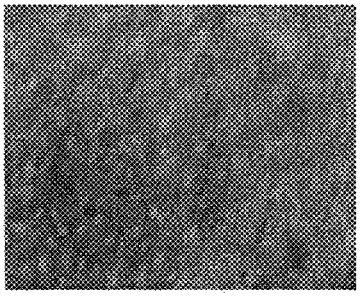
FIG. 8B is a fluorescent microscope image of human mesenchymal stem cells (hMSCs) cultured and grown on three-dimensional scaffolds prepared according to the present inventive method, shown after three days.
Figure 8C:
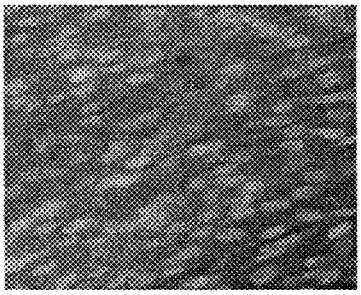
FIG. 8C is a fluorescent microscope image of human mesenchymal stem cells (hMSCs) cultured and grown on three-dimensional scaffolds prepared according to the present inventive method, shown after seven days.

FIGS. 8A, 8B and 8C are fluorescent microscope images of human mesenchymal stem cells (hMSCs) cultured and grown on cellulose nanofibril films prepared according to the present inventive method, shown respectively after one day, three days, and seven days. Acridine orange/ethidium bromide staining was used. It is important to note that the morphological assessment results matched those of the cell viability assay to a high degree. Even as the cellulose nanofibril dose and exposure time increased, the hMSCs viability and morphology had no differences when compared against the control samples. Furthermore, the cell attachment and proliferation were analyzed using three-dimensional cell cultures on three-dimensional scaffolds formed from the cellulose nanofibrils. The cells easily attached to the cellulose nanofibril-based scaffolds and cells grew evenly on the surface. The three-dimensional cell culture images revealed that the cellulose nanofibrils trigger the hMSC adhesion and proliferation. The cellulose nanofibrils are biocompatible and can be used for tissue engineering and regenerative medicine. The cellulose nanofibrils can be a suitable matrix for stem cell differentiation and skin tissue applications.

It is to be understood that the present invention is not limited to the embodiments described above, but encompasses any and all embodiments within the scope of the following claims.

We claim:

1. A method of producing cellulose nanofibrils, comprising the steps of:

pulverizing a quantity of *Bassia eriophora* plants to obtain powdered *Bassia eriophora;* immersing the powdered *Bassia eriophora* in a 3.0 vol % aqueous solution of sodium hydroxide to obtain alkali-treated *Bassia eriophora;* heating the alkali-treated *Bassia eriophora* at approximately 120° C. for approximately two hours under pressurized conditions;

washing excess alkali solution from the alkali-treated *Bassia eriophora* after heating to provide washed, alkali-treated *Bassia eriophora;* drying the washed, alkali-treated *Bassia eriophora* at 50° C. for eight hours to provide dried *Bassia eriophora;* bleaching the dried and washed *Bassia eriophora* to obtain bleached *Bassia eriophora*, wherein the step of bleaching the dried and washed alkali-treated *Bassia eriophora* comprises bleaching in a 1:1 solution of sodium hypochlorite and an acetate buffer at approximately 120° C. for approximately one hour under pressurized conditions;

washing the bleached *Bassia eriophora*, wherein the washing is done until a neutral pH is achieved;

drying the bleached *Bassia eriophora* at a temperature of approximately 50° C. for approximately eight hours to obtain cellulose;

hydrolyzing the cellulose with 50% sulfuric acid at a temperature of approximately 45° C. for approximately 30 minutes under stirring to produce acid hydrolyzed cellulose;

diluting the acid hydrolyzed cellulose with water to produce an aqueous cellulose solution;

centrifuging the aqueous cellulose solution to produce cellulose residue, wherein centrifuging the aqueous cellulose solution is at 5,000 RPM for approximately 10 minutes; and ultrasonicating the cellulose residue to produce cellulose nanofibrils, wherein the ultrasonicating is for 20 minutes to produce the nanofibrils having a diameter of 10-30 nm and a length of 3-5 μm.

* * * * *